US010485349B1

(12) United States Patent
Grandberg

(10) Patent No.: US 10,485,349 B1
(45) Date of Patent: Nov. 26, 2019

(54) FOLDABLE CHAIR

(71) Applicant: Ira Grandberg, Mt. Kisco, NY (US)

(72) Inventor: Ira Grandberg, Mt. Kisco, NY (US)

( * ) Notice: Subject to any disclaimer, the term of this patent is extended or adjusted under 35 U.S.C. 154(b) by 0 days.

(21) Appl. No.: 16/402,419

(22) Filed: May 3, 2019

(51) Int. Cl.
*A47C 4/04* (2006.01)
*A47C 4/10* (2006.01)
*A47C 4/20* (2006.01)

(52) U.S. Cl.
CPC . *A47C 4/10* (2013.01); *A47C 4/20* (2013.01)

(58) Field of Classification Search
CPC .. A47C 4/10; A47C 4/20; A47C 4/045; A61G 5/08; A61G 5/006; A47D 1/02
See application file for complete search history.

(56) References Cited

U.S. PATENT DOCUMENTS 1,622,327 A * 3/1927 Livingood ..... A47B 83/02 297/139
2,649,147 A * 8/1953 Sanford ..... A47C 3/12 297/411.41
4,009,903 A 3/1977 Manspeaker
4,123,101 A 10/1978 Minsker
4,202,581 A 5/1980 Fleishman
D256,857 S * 9/1980 Tallon ..... D6/374
4,244,619 A * 1/1981 Yoshimura ..... A47C 4/08 297/34
4,390,204 A * 6/1983 Fleishman ..... A47B 3/06 297/16.1
4,533,174 A * 8/1985 Fleishman ..... A47B 3/06 297/16.1
4,984,848 A * 1/1991 Scalisi ..... A47C 5/005 248/152
5,185,892 A 2/1993 Mitchell
D390,022 S * 2/1998 Jus ..... D6/368
5,865,710 A * 2/1999 Wilson-Hyde ..... A63B 23/0458 297/214
7,387,334 B2 * 6/2008 Phipps ..... A47C 4/14 297/17
9,345,329 B2 * 5/2016 Gendell ..... A47C 4/04
10,136,730 B2 * 11/2018 Kim ..... A47C 4/04
10,247,230 B2 * 4/2019 McCullough ..... E05D 3/04
2006/0186711 A1 * 8/2006 Phipps ..... A47C 4/14 297/46
2008/0238156 A1 * 10/2008 Miyakawa ..... A47B 85/06 297/19
2012/0267920 A1 * 10/2012 Voris ..... A47C 4/045 297/16.1
2014/0084765 A1 * 3/2014 Riley ..... A47C 31/023 312/258

(Continued)

FOREIGN PATENT DOCUMENTS

CN 202636213 U 1/2013
CN 203220138 U 10/2013

(Continued)

*Primary Examiner* — Shin H Kim
(74) *Attorney, Agent, or Firm* — Robert P. Michal, Esq.; Carter, DeLuca & Farrell LLP

(57) ABSTRACT

A foldable chair includes a frame, a seat pivotably coupled to the frame, and a leg pivotably coupled to the seat. The foldable chair is easily transitionable between folded and unfolded states. The frame, the seat, and the leg are substantially coplanar with one another when the foldable chair is in the folded state.

20 Claims, 3 Drawing Sheets

(56) References Cited

U.S. PATENT DOCUMENTS

| | | | | |
|---|---|---|---|---|
| 2015/0083522 | A1* | 3/2015 | Chancier | A47C 9/10<br>182/152 |
| 2015/0289657 | A1* | 10/2015 | Gendell | A47C 4/08<br>297/16.1 |
| 2016/0220026 | A1* | 8/2016 | Siao | A47C 4/045 |
| 2017/0238712 | A1* | 8/2017 | Kim | A47C 4/04 |
| 2017/0292565 | A1* | 10/2017 | McCullough | E05D 3/04 |
| 2019/0090640 | A1* | 3/2019 | Kim | A47C 4/04 |

FOREIGN PATENT DOCUMENTS

| | | | |
|---|---|---|---|
| CN | 203897796 | U | 10/2014 |
| CN | 208658425 | U | 3/2019 |
| FR | 2403046 | A1 | 4/1979 |
| GB | 2200043 | A | 7/1988 |
| JP | 2013154043 | A | 8/2013 |
| RU | 2126223 | C1 | 2/1999 |

* cited by examiner

FOLDABLE CHAIR

BACKGROUND

The disclosure relates to chairs and, more particularly, to foldable chairs having a compact folded state.

A typical chair has four legs supporting a seat and a back. Some chairs may be transitionable from an open state to a folded state. Chairs may be foldable to reduce their overall footprint to make them easier to store when not in use. Many foldable chairs are difficult to operate, continue to occupy a large area even when in the folded state, unstable, and uncomfortable.

SUMMARY

In accordance with an aspect of the disclosure, a foldable chair is provided and includes a frame, a seat, and a leg. The seat has a first end portion pivotably coupled to the frame and defines a slot. The seat is configured to pivot relative to the frame between a folded state and an unfolded state. The leg has a first end portion pivotably coupled to a second end portion of the seat. The leg is configured to pivot relative to the seat between a folded state in which a portion of the leg is received in the slot of the seat, and an unfolded state.

In aspects, the leg may be coplanar with the seat when the leg is in the folded state.

In aspects, the first end portion of the leg may be an elongated shaft configured for receipt in the slot of the seat. The second end portion of the leg may be a crossbeam extending perpendicularly relative to the elongated shaft.

In aspects, the crossbeam may be disposed adjacent the first end portion of the seat when the leg is in the folded state.

In aspects, the crossbeam may be coplanar with the first end portion of the seat when the leg is in the folded state In aspects, the foldable chair may further include a back coupled to an upper end portion of the frame.

In aspects, the second end portion of the leg may be received in a space cooperatively defined by the frame, the back, and the seat when the leg and seat are in the folded state.

In aspects, the back may define an arcuate cutout in a bottom end portion thereof, and the second end portion of the leg may define an arcuate cutout therein.

In aspects, the arcuate cutout of the back and the arcuate cutout of the leg may cooperatively define a circular hole when the seat and leg are in the folded state.

In aspects, the back may be pivotably coupled to the upper end portion of the frame.

In aspects, the seat and the back may have a first color associated therewith, and the frame and the leg may have a second color associated therewith, different from the first color.

In aspects, the leg may extend perpendicularly from the second end portion of the seat when the leg is in the unfolded state.

In aspects, the frame may include a pair of parallel, longitudinally-extending struts, and a base extending between bottom end portions of the struts. The seat, the leg, the struts, and the base may all be coplanar when the seat and the leg are in the folded state.

In accordance with another aspect of the disclosure, a foldable chair is provided and includes a frame, a seat coupled to the frame, and a leg coupled to the seat. The seat is configured to pivot relative to the frame between a folded state, in which the seat is coplanar with the frame, and an unfolded state in which the seat extends perpendicularly from the frame. The leg is configured to pivot relative to the seat between a folded state in which the leg is coplanar with the seat, and an unfolded state in which the leg extends perpendicularly from the seat.

In aspects, the leg may include an elongated shaft pivotably coupled to the seat, and a crossbeam attached to the elongated shaft. The crossbeam may extend perpendicularly relative to the elongated shaft.

In aspects, the seat may define a slot therein configured for receipt of the elongated shaft of the leg when the leg is in the folded state.

In aspects, the crossbeam of the leg may be disposed above and coplanar with the seat when the seat and leg are in the folded state.

In aspects, the foldable chair may further include a back coupled to an upper end portion of the frame. The crossbeam of the leg may be received in a space cooperatively defined by the frame, the back, and the seat when the leg and seat are in the folded state.

In aspects, the back may define an arcuate cutout in a bottom end portion thereof, and the crossbeam of the leg may define an arcuate cutout therein. The arcuate cutout of the back and the arcuate cutout of the leg may cooperatively define a circular hole when the seat and leg are in the folded state.

In accordance with another aspect of the disclosure, a method of transitioning a foldable chair is provided and includes pivoting a leg relative to a seat, whereby a portion of the leg is received in a slot defined in the seat; and pivoting the leg and the seat together relative to a frame, whereby the leg and seat become coplanar with the frame.

As used herein, the term "upper" refers to the portion of a folded chair that is being described which is closer to a head of a seated individual, while the term "lower" refers to the portion of a folded chair that is being described which is further from a head of a seated individual. As used herein, the term "upper" refers to the portion of an opened chair that is being described which is closer to a rear end of a seated individual, while the term "distal" refers to the portion of an opened chair that is being described which is further from a rear end of a seated individual.

As used herein, the terms parallel and perpendicular are understood to include relative configurations that are substantially parallel and substantially perpendicular up to about +/−10 degrees from true parallel and true perpendicular.

To the extent consistent, any of the aspects described herein may be used in conjunction with any or all of the other aspects described herein.

BRIEF DESCRIPTION OF THE DRAWINGS

Various aspects and features of the disclosure are described hereinbelow with reference to the drawings wherein like numerals designate identical or corresponding elements in each of the several views.

DETAILED DESCRIPTION

Figure 1:
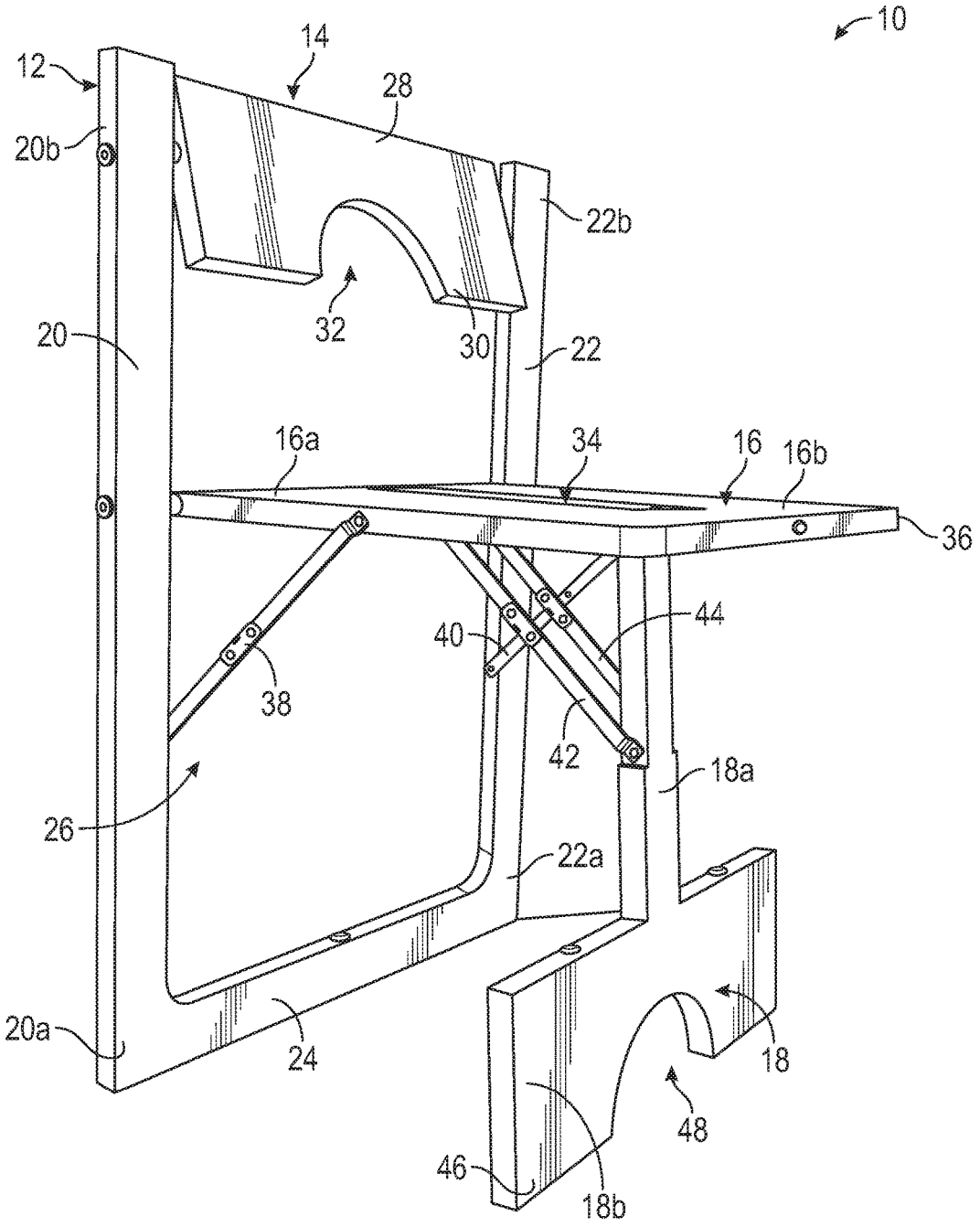
FIG. 1 is a side, perspective view illustrating an embodiment of a foldable chair with a seat and a leg in an unfolded or opened state.

FIG. 1 illustrates a foldable chair 10 configured to transition between an opened configuration, such as, for example, an unfolded state, and a closed configuration, such as, for example, a folded state. The foldable chair 10 generally includes a wood frame 12, a back 14, a seat 16, and a leg 18 each having the same thickness. In aspects, the components of the foldable chair 10 may have varying thicknesses or substantially the same thicknesses. The frame 12 has a rectangular shape and includes a pair of parallel, longitudinally-extending struts 20, 22 and a base 24 interconnecting and extending between lower end portions 20*a*, 22*a* of the respective struts 20, 22. The struts 20, 22 and the base 24 may be monolithically formed or connected to one another. In aspects, the frame 12 may assume any suitable shape (e.g., square, round, triangular, etc.) and may be fabricated from any suitable type of material, such as, for example, Baltic birch, metal, plastic, etc. The frame 12 defines a U-shaped cavity 26 occupied entirely by the back 14, the seat 16, and the leg 18 when the foldable chair 10 is in the folded state.

The back 14 (e.g., a plate) of the foldable chair 10 may have a flat, rectangular configuration and is pivotably coupled at its ends to respective upper end portions 20*b*, 22*b* of the struts 20, 22 of the frame 12 via any suitable pivotable connection, such as a pin and hole connection. In aspects, the back 14 may be non-pivotably coupled to the frame 12. The back 14 has an upper end portion 28 that is flush with the upper end portions 20*b*, 22*b* of the struts 20, 22, and a lower end portion 30. The lower end portion 30 of the back 14 defines an arcuate cutout 32 therein. In aspects, the cutout 32 may have any suitable shape, such as, for example, squared, triangular, irregular, or the like. The cutout 32 in the back 14 may assist a user in grasping and holding the foldable chair 10 and/or hanging the foldable chair 10.

Figure 2:
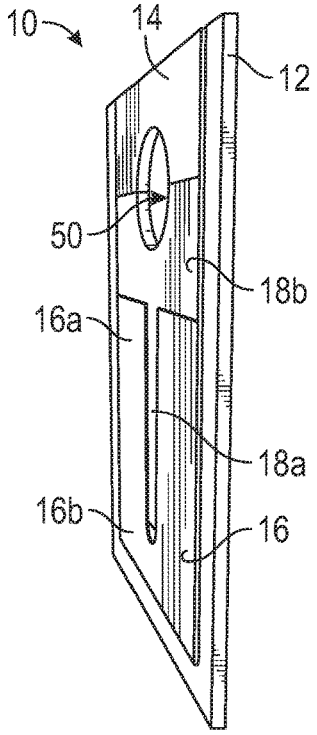
FIG. 2 is a side, perspective view illustrating the foldable chair of FIG. 1 with the seat and leg in a folded or closed state.
Figure 3:
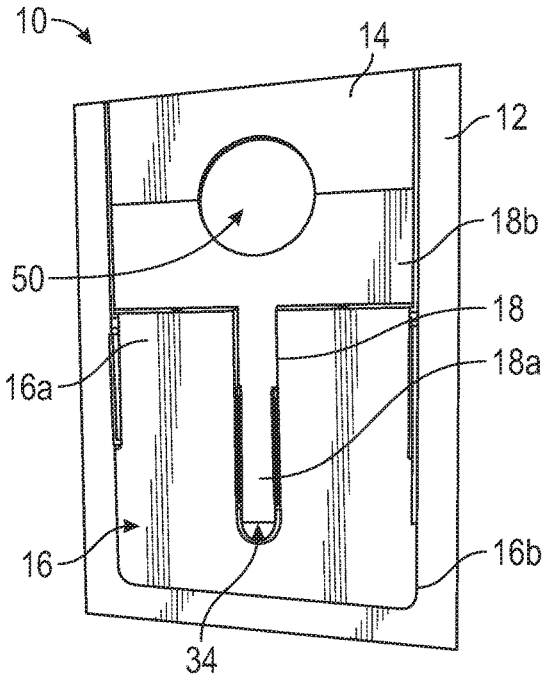
FIG. 3 is a front view of the foldable chair of FIG. 1 with the seat and the leg in the folded state.

The seat 16 of the foldable chair 10 is coupled to the frame 12 and configured to pivot relative to the frame 12 between an unfolded state (FIG. 1), in which the seat 16 extends perpendicularly relative to the frame 12, and a folded state (FIGS. 2 and 3), in which the seat 16 is coplanar with the frame 12. The seat 16 has a first end portion 16*a* pivotably coupled to the opposing struts 20, 22 of the frame 12 at lateral sides of the seat 16. The seat 16 defines an elongated slot 34 that extends from the first end portion 16*a* of the seat 16 and terminates proximally of a distal-most end 36 of a distal end portion 16*b* of the seat 16. The seat 16 may be selectively fixed in the unfolded/opened state relative to the frame 12 with a pair of lock-stays 38, 40 that couple the lateral sides of the seat 16 to the respective struts 20, 22 of the frame 12.

The leg 18 of the foldable chair 10 is coupled to the seat 16 and is configured to pivot relative to the frame 12 between an unfolded state (FIG. 1), in which the leg 18 extends perpendicularly relative to the seat 16, and a folded state (FIGS. 2 and 3), in which the leg 18 is coplanar with the seat 16. The leg 18 has a first end portion, such as, for example, an elongated shaft 18*a*, and a crossbeam 18*b* connected to or monolithically formed with the elongated shaft 18*a*. The elongated shaft 18*a* of the leg 18 is pivotably coupled to the second end portion 16*b* of the seat 16 at a location within the slot 34 of the seat 16. The elongated shaft 18*a* has a length substantially equal to a length of the slot 34 and a width substantially equal to a width of the slot 34. The elongated shaft 18*a* of the leg 18 may be selectively fixed in the unfolded/opened state relative to the seat 16 with a pair of lock-stays 42, 44 that couple lateral sides of the elongated shaft 18*a* to the respective lateral sides of the seat 16. In aspects, a semicircular gap may be provided between the end of the elongated shaft 18*a* and the distal end portion 16*b* of the seat 16 configured for receipt of a user's finger or hand to assist in folding and unfolding the leg 18.

The crossbeam 18*b* of the leg 18 extends perpendicularly relative to the elongated shaft 18, such that the leg 18 assumes a T-shaped configuration. The crossbeam 18*b* may assume a substantially similar or identical shape and overall outer dimension as the back 14. The crossbeam 18*b* has a bottom end portion 46 that defines an arcuate cutout 48, such that upon moving the seat 16 and leg 18 to their folded states (FIGS. 2 and 3), the arcuate cutout 48 in the crossbeam 18*b* of the leg 18 and the arcuate cutout 32 in the back 14 cooperatively define a closed, circular opening 50.

The frame 12 and the leg 18 each have the same color, and the seat 16 and the back 14 each have the same color, different from the color of the frame 12 and the leg 18. By providing the seat 16 and the back 14 with a matching color that is discrete from the color of the frame 12 and the leg 18, a user may readily differentiate between the structural components (e.g., the frame 12 and the leg 18) of the foldable chair 10 and the seating components (e.g., the seat 16 and the back 14) of the foldable chair 10. This may assist a user in transitioning the foldable chair 10 from the unfolded state to the folded state. In aspects, the frame 12 and leg 18 may have the inherent color of the material it is fabricated from (e.g., wood), and the seat 16 and back 14 may have a vibrant color (e.g., blue, orange, red, yellow, etc.) coated thereon.

Figure 4C:
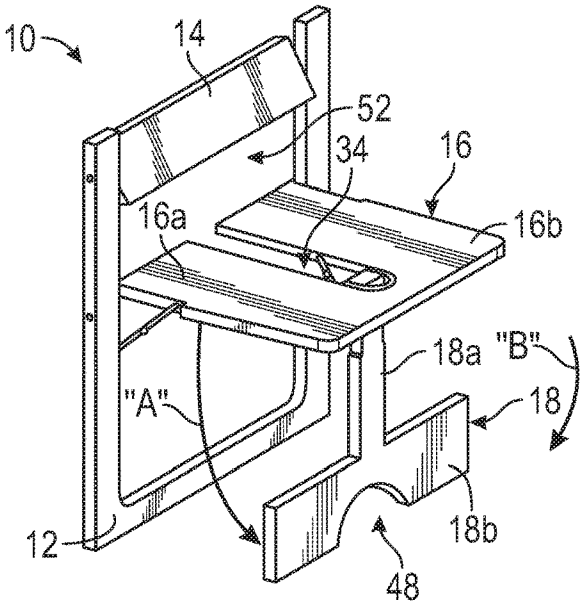
FIGS. 4A-4C are side perspective views illustrating a three step sequence of unfolding the foldable chair of FIG. 1.
Figure 4B:
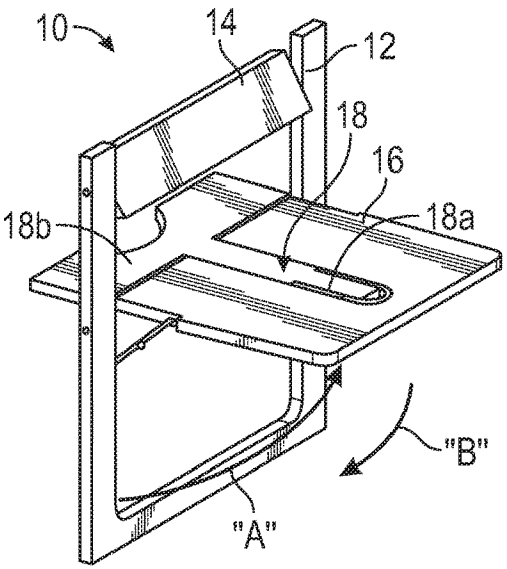
Figure 4A:
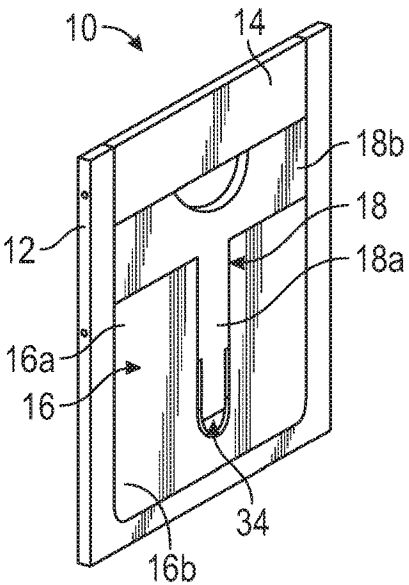

In use, to transition the foldable chair 10 from the folded state (FIG. 4A) to the unfolded state (FIG. 4C), the second end portion 16*b* of the seat 16 is pivoted in the direction indicated by arrow "A" in FIG. 4B to orient the seat perpendicularly relative to the frame 12. The lock-stays 38, 40 (FIG. 1) may be employed to lock the seat 16 in the unfolded state. The crossbeam 18*b* of the leg 18 is rotated in the same direction as the seat 16, namely the direction indicated by arrow "A" in FIG. 4C, to orient the leg 18 perpendicularly relative to the seat 16. The lock-stays 42, 44 (FIG. 1) may be employed to lock the leg 18 in the unfolded state.

In aspects, the overall height of the foldable chair 10 may be about 29 inches, the overall width of the foldable chair 10 may be about 20 inches, the distance between the base 24 of the frame 12 and the crossbeam 18*b* of the leg 18 when the foldable chair 10 is in the unfolded state may be about 16 inches, the height defined between the seat 16 and base 24 of the frame 12 when the foldable chair 10 is in the unfolded state may be about 18 inches, and the height defined between the seat 16 and the bottom end of the back 14 when the foldable chair 10 is in the unfolded state may be about 6 inches. It is contemplated, that the relative dimensions of the components of the foldable chair 10 may be variously configured.

To transition the foldable chair 10 from the unfolded state (FIG. 4C) to the folded state (FIG. 4A), the leg 18 may be first pivoted relative to the seat 16 in the direction indicated by arrow "B" in FIG. 4C. As the leg 18 is moved to the folded state, the elongated shaft 18*a* of the leg 18 is received in the slot 34 of the seat 16 and the crossbeam 18*b* of the leg 18 is disposed adjacent the first end portion 16*a* of the seat 16. With the leg 18 in the folded state relative to the seat 16, the leg 18 and seat 16 may be rotated together in the direction indicated by arrow "B" in FIG. 4B. As the leg 18 and seat 16 are rotated toward the folded state, the crossbeam 18*b* of the leg 18 occupies a space 52 (FIG. 4C) defined by the frame 12, the back 14, and the seat 16. In the folded state, the leg 18, the back 14, the seat 16, and the frame 12 are coplanar, thereby reducing the overall volume of the foldable chair 10 and facilitating stacking of multiple of the foldable chairs 10.

Persons skilled in the art will understand that the structures and methods specifically described herein and shown in the accompanying figures are non-limiting exemplary embodiments, and that the description, disclosure, and figures should be construed merely as exemplary of particular embodiments. It is to be understood, therefore, that the disclosure is not limited to the precise embodiments described, and that various other changes and modifications may be effected by one skilled in the art without departing from the scope or spirit of the disclosure. Additionally, the elements and features shown or described in connection with certain embodiments may be combined with the elements and features of certain other embodiments without departing from the scope of the disclosure, and that such modifications and variations are also included within the scope of the disclosure. Accordingly, the subject matter of the disclosure is not limited by what has been particularly shown and described.

What is claimed is:

1. A foldable chair, comprising:

a frame;

a seat having a first end portion pivotably coupled to the frame, and a second end portion, the seat configured to pivot relative to the frame between a folded state and an unfolded state, the seat defining a slot; and a leg having a first end portion pivotably coupled to the second end portion of the seat, the leg being configured to pivot relative to the seat between a folded state in which a portion of the leg is received in the slot of the seat, and an unfolded state, wherein the first end portion of the leg is an elongated shaft configured for receipt in the slot of the seat, and the second end portion of the leg is a crossbeam extending perpendicularly relative to the elongated shaft.

2. The foldable chair according to claim 1, wherein the leg is coplanar with the seat when the leg is in the folded state.

3. The foldable chair according to claim 1, wherein the crossbeam is disposed adjacent the first end portion of the seat when the leg is in the folded state.

4. The foldable chair according to claim 3, wherein the crossbeam is coplanar with the first end portion of the seat when the leg is in the folded state.

5. The foldable chair according to claim 1, further comprising a back coupled to an upper end portion of the frame.

6. The foldable chair according to claim 5, wherein the second end portion of the leg is received in a space cooperatively defined by the frame, the back, and the seat when the leg and seat are in the folded state.

7. The foldable chair according to claim 5, wherein the back defines an arcuate cutout in a bottom end portion thereof, and the second end portion of the leg defines an arcuate cutout therein.

8. The foldable chair according to claim 7, wherein the arcuate cutout of the back and the arcuate cutout of the leg cooperatively define a circular hole when the seat and leg are in the folded state.

9. The foldable chair according to claim 5, wherein the back is pivotably coupled to the upper end portion of the frame.

10. The foldable chair according to claim 5, wherein the seat and the back have a first color associated therewith, and the frame and the leg have a second color associated therewith, different from the first color.

11. The foldable chair according to claim 1, wherein the leg extends perpendicularly from the second end portion of the seat when the leg is in the unfolded state.

12. The foldable chair according to claim 1, wherein the frame includes:

a pair of parallel, longitudinally-extending struts; and a base extending between bottom end portions of the struts, wherein the seat, the leg, the struts, and the base are all coplanar when the seat and the leg are in the folded state.

13. A foldable chair, comprising:

a frame;

a seat coupled to the frame and configured to pivot relative to the frame between a folded state, in which the seat is coplanar with the frame, and an unfolded state in which the seat extends perpendicularly from the frame; and a leg coupled to the seat, wherein the leg is configured to pivot relative to the seat between a folded state in which the leg is coplanar with the seat, and an unfolded state in which the leg extends perpendicularly from the seat.

14. The foldable chair according to claim 13, wherein the leg includes:

an elongated shaft pivotably coupled to the seat; and a crossbeam attached to the elongated shaft and extending perpendicularly relative to the elongated shaft.

15. The foldable chair according to claim 14, wherein the seat defines a slot therein configured for receipt of the elongated shaft of the leg when the leg is in the folded state.

16. The foldable chair according to claim 15, wherein the crossbeam of the leg is disposed above and coplanar with the seat when the seat and leg are in the folded state.

17. The foldable chair according to claim 14, further comprising a back coupled to an upper end portion of the frame, wherein the crossbeam of the leg is received in a space cooperatively defined by the frame, the back, and the seat when the leg and seat are in the folded state.

18. The foldable chair according to claim 17, wherein the back defines an arcuate cutout in a bottom end portion thereof, and the crossbeam of the leg defines an arcuate cutout therein, the arcuate cutout of the back and the arcuate cutout of the leg cooperatively define a circular hole when the seat and leg are in the folded state.

19. A foldable chair, comprising:

a frame;

a seat having a first end portion pivotably coupled to the frame, and a second end portion, the seat configured to pivot relative to the frame between a folded state and an unfolded state, the seat defining a slot; and a leg having a first end portion pivotably coupled to the second end portion of the seat, wherein the leg is configured to pivot relative to the seat between a folded state in which a portion of the leg is received in the slot of the seat, and an unfolded state, in which the leg extends perpendicularly from the second end portion of the seat.

20. The foldable chair according to claim 19, wherein the frame includes:

a pair of parallel, longitudinally-extending struts; and a base extending between bottom end portions of the struts, wherein the seat, the leg, the struts, and the base are all coplanar when the seat and the leg are in the folded state.

* * * * *